United States Patent [19]

Rolff et al.

[11] Patent Number: 4,461,690

[45] Date of Patent: Jul. 24, 1984

[54] SYSTEM FOR EQUALIZING CURRENT FLOW IN A PLURALITY OF BRANCH CIRCUITS SUCH AS ARE USED IN ELECTROPLATING BATHS

[75] Inventors: Rolf Rolff; Detlev Nitsche, both of Berlin, Fed. Rep. of Germany

[73] Assignee: Schering AG, Berlin and Bergkamen, Fed. Rep. of Germany

[21] Appl. No.: 432,393

[22] Filed: Sep. 30, 1982

Related U.S. Application Data

[63] Continuation of Ser. No. 216,608, Dec. 12, 1980, abandoned.

[30] Foreign Application Priority Data

Dec. 19, 1979 [DE] Fed. Rep. of Germany ..... 2951708

[51] Int. Cl.[3] ..... C25D 3/00

[52] U.S. Cl. ..... 204/228; 204/1 R; 204/1 T; 307/32; 307/34; 323/267

[58] Field of Search ..... 204/228, 1 R, 1 T, 231, 204/DIG. 7; 323/267-269; 307/31, 32, 34

[56] References Cited

U.S. PATENT DOCUMENTS

| | | | |
|---|---|---|---|
| 3,470,082 | 9/1969 | Raymond et al. | 204/228 |
| 3,629,548 | 12/1971 | Rygiol | 307/34 |
| 3,675,114 | 7/1972 | Nercessian | 323/269 |

FOREIGN PATENT DOCUMENTS

| | | | |
|---|---|---|---|
| 1800954 | 6/1970 | Fed. Rep. of Germany | 204/228 |
| 1042059 | 9/1966 | United Kingdom | 204/228 |

OTHER PUBLICATIONS

IBM Technical Disclosure Bulletin, vol. 21, No. 4, p. 1610, Sep. 1978.

*Primary Examiner*—William H. Beha, Jr.
*Attorney, Agent, or Firm*—Michael J. Striker

[57] ABSTRACT

A reference branch circuit includes a voltage divider. Each of at least one regulated branch circuits includes the collector-emitter circuit of a regulating transistor and a measuring resistance. Each regulated branch circuit is associated with a comparator, which compares voltage across the measuring resistance of the corresponding regulated branch circuit to a reference voltage appearing at a reference tap of the voltage divider in the reference branch circuit. Current passing through each regulated branch circuit is regulated to be equal to the current flowing through the reference branch circuit.

9 Claims, 1 Drawing Figure

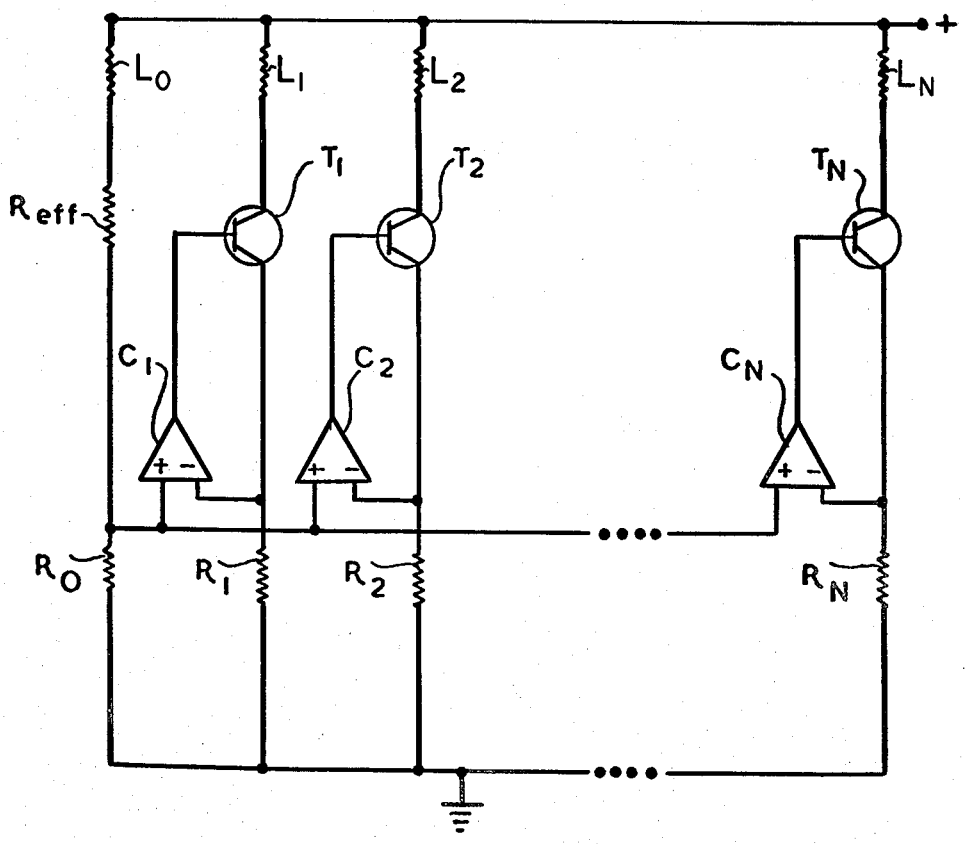
+
$L_0$
$L_1$
$L_2$
$L_N$
$T_1$
$T_2$
$T_N$
$R_{eff}$
$C_1$
$C_2$
$C_N$
$R_0$
$R_1$
$R_2$
$R_N$

SYSTEM FOR EQUALIZING CURRENT FLOW IN A PLURALITY OF BRANCH CIRCUITS SUCH AS ARE USED IN ELECTROPLATING BATHS

This is a continuation of application Ser. No. 216,608, filed Dec. 12, 1980, now abandoned.

BACKGROUND OF THE INVENTION

This invention pertains to equalizing current flow in a plurality of branch circuits. Such branch circuits are used in galvanic or electroplating baths in order to electroplate a plurality of articles simultaneously.

When a plurality of articles are simultaneously electroplated in an electroplating bath, the articles are all hung from a common bench. It is known that the current density about the object so electroplated can vary as a result of, e.g., unequal distances of the objects from the anodes through which direct current is caused to flow. Additionally, it is known that when a large bench is utilized, the current density about objects in the middle of the bench is lesser than the current density about objects at the edge of the bench. In the event that the objects do not move in a fully symmetrical fashion, variation in current density can only be amplified. Moreover, it is possible that the connections between the objects which are to be electroplated and the bench or the anodes may not all be equally good. As a result of variation in the resistances of such connections, or in variations in resistance within an anode basket, variations in current density can also arise.

Regardless of the cause of variation of current density within an electroplating bath, such variations in current density result in varying precipitation speeds and therefore result in variations in thickness of the electroplated layer which is electroplated onto each of the objects. For planar objects, the two sides of the object may be plated with electroplating of varying thickness. In practice, this is most unsatisfactory and results in an unacceptable manufacturing expense, especially in the case of electroplating baths which electroplate objects with layers of precious metals.

Therefore, it would be advantageous to provide a system and a method which would equalize current flow in a plurality of branch circuits such as are used in an electroplating or galvanic bath which is designed to electroplate a plurality of articles simultaneously, to prevent variation in current density from arising and thereby equalize precipitation speed from object to object in the electroplating bath.

SUMMARY OF THE INVENTION

This object, among others which will become apparent hereinafter, is achieved by utilizing one of the branch circuits in an electroplating bath of this type as a reference branch circuit, and regulating DC current flow in all the other branch circuits (hereinafter denominated "regulated branch circuits") in accordance with current flowing in the reference branch circuit. By so doing, variations in DC current flow in the reference branch circuit will cause corresponding changes in DC current flow in all the regulated branch circuits, equalizing current density and thereby making the electroplating process more uniform from object to object.

In the system used herein, high-power regulating transistors are placed in each regulated branch circuit, with the collector-emitter circuit of each transistor forming a part of the regulated branch circuit. Each regulating transistor is so chosen that with zero base voltage, and at the desired operating DC current, the collector-emitter circuit will be observed as a resistance having an effective value of $R_{eff}$. The reference branch circuit contains a voltage divider with a first reference resistance having a resistance value equal to $R_{eff}$, and with a reference tap.

Each of the regulated branch circuits includes a measuring resistance. For each regulating transistor, a comparator is provided which compares voltage at the reference tap with the voltage across each measuring resistance. Hence, three components are associated with each of the regulated branch circuits: a measuring resistance, a regulating transistor, and a comparator, which comparator drives the regulating transistor.

Each comparator compares the voltage across its corresponding measuring resistance with the voltage at the reference tap in the reference branch circuit, and drives its corresponding regulating transistor in such a fashion as to equalize the current flowing in its own regulated branch circuit with the current flowing in the reference branch circuit.

The differences in current density flowing in the electroplating bath are thus eliminated, regardless of their cause. Changes in current flowing through the reference branch circuit are immediately transmitted to the comparators, causing current flowing in the regulated branch circuits to be correspondingly changed. In the event that changes in current flow in any one regulated branch circuit or in more than one regulated branch circuit take place, the individual regulated branch circuit or circuits are each adjusted in an individual fashion by changes in conductivity of the corresponding regulating transistor or regulating transistors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a schematic diagram of the system which embodies the invention.

DETAILED DESCRIPTION OF PREFERRED EMBODIMENTS

In the following discussion, it will be assumed that there exists an electroplating bath which is designed to electroplate a plurality of objects simultaneously. The objects (cathodes) together with assigned anodes and corresponding portions of the bath are designated as loads $L_0 \ldots L_n$. The invention disclosed herein may be used either in the anode circuit or in the cathode circuit or both, depending upon the application desired.

In the preferred embodiment of the invention, the invention is installed in the cathode circuit of such an electroplating bath. It will be assumed that at least two objects will be electroplated simultaneously, and that one object will be electroplated by a reference branch circuit. All other objects will be electroplated by regulated branch circuits. In the event that N+1 objects are to be electroplated, there will be one object electroplated by the reference branch circuit, while the remaining N objects will be electroplated by the remaining N regulated branch circuits.

Each regulated branch circuit contains the collector-emitter circuit of a transistor. In the FIGURE, the regulating transistors are identified with subscripts corresponding to the regulated branch circuits of which they are a part. Thus, regulating transistor $T_1$ has its collector-emitter circuit in the first regulated branch circuit, transistor $T_2$ has its collector-emitter circuit in the second regulated branch circuit, and transistor $T_n$ has its collector-emitter circuit in the nth regulated branch circuit.

In the preferred embodiment, all the regulating transistors are identical, and are manufactured by the Westinghouse Brake and Signal Company, Ltd. in England as Type Number WT 4303. Each of these transistors carries 100 amperes DC with an effective resistance $R_{eff}$. Because of the high currents carried by the regulating transistors $T_1$-$T_n$, the transistors are connected to very large heat sinks and the heat sinks and regulating transistors are water cooled.

The base of each regulating transistor $T_1$-$T_n$ is connected to the output of a corresponding comparator $C_1$-$C_n$. Thus, the output of comparator $C_1$ is connected to the base of regulating transistor $T_1$, the output of comparator $C_2$ is connected to the base of regulating transistor $T_2$, and so forth. Each of comparators $C_1$-$C_n$ is an operational amplifier. The inverting input of each comparator $C_1$-$C_n$ is connected to the emitter of a corresponding regulating transistor $T_1$-$T_n$, so that the inverting input of comparator $C_1$ is connected to the emitter of regulating transistor $T_1$, the inverting input of comparator $C_2$ is connected to the emitter of regulating transistor $T_2$, and so forth.

Each of the regulated branch circuits is furthermore provided with a measuring resistance, which measuring resistance is identified with a subscript corresponding to the regulated branch circuit of which it forms a part. As shown in the FIGURE, measuring resistance $R_1$ is a fixed resistor connected between the common junction point of the emitter of regulating transistor $T_1$ and the inverting input of comparator $C_1$, and ground. The same connections hold true with measuring resistances $R_2$-$R_n$. Thus, it can be seen that all of regulating transistors $T_1$-$T_n$ are connected in a common-emitter configuration to ground by measuring resistances $R_1$-$R_n$ respectively. In the preferred embodiment, all measurement resistances $R_1$-$R_n$ are identical fixed resistors having resistance values on the order of 1 milliohm.

In the reference branch circuit, a voltage divider is installed, which voltage divider includes a first reference resistance having a resistance value equal to $R_{eff}$. Furthermore, the voltage divider further includes a second reference resistance $R_0$. In the preferred embodiment, $R_0$ has a resistance value equal to that of all measuring resistances $R_1$-$R_n$. The voltage divider is so ordered that second reference resistance $R_0$ is connected at one end to ground and at the other end to one end of first reference resistor $R_{eff}$. The common junction point between the first and second reference resistances $R_{eff}$ and $R_0$ respectively is a reference tap.

The non-inverting inputs of all comparators $C_1$-$C_n$ are connected together at a first common point, which first common point is the reference tap in the voltage divider.

$R_{eff}$ is on the order of 100 milliohms. Comparators $C_1$-$C_n$ are all identical and have amplification factors of 50. It will be immediately apparent to those skilled in the art that by setting first reference resistance $R_{eff}$ equal to the effective collector-emitter resistances of regulating transistors $T_1$-$T_n$, and by setting second reference resistance $R_0$ equal to all of measuring resistances $R_1$-$R_n$, a series of N+1 like voltage dividers are established, assuming that the voltages of the bases of regulating transistors $T_1$-$T_n$ are all zero.

Assuming that the collectors of regulating transistors $T_1$-$T_n$ and the hot end of first reference resistance $R_{eff}$ are connected to the cathodes in an electroplating bath, and assuming that each of the branch circuits is to carry 100 amperes, each branch circuit will carry 100 amperes, causing voltage drops to appear across all of regulating transistors $T_1$-$T_n$ and all resistors $R_{eff}$, $R_0$, $R_1$ . . . $R_n$. Therefore, voltages at the ungrounded ends of resistors $R_0$-$R_n$ will be equal to 100 millivolts. Therefore, the outputs of comparators $C_1$-$C_n$ will all be zero, since the voltages at the inverting inputs of all of comparators $C_1$-$C_n$ will be equal to the voltage at the non-inverting inputs thereof. However, in the event that the current in the first regulated branch circuit drops to 99 amperes as a result of a poor electrical connection, a movement of the object being electroplated, or as a result of any other factor, the voltage drop across measuring resistance $R_1$ will drop to 99 millivolts. Therefore, there will be a 1 millivolt difference between the voltages at the non-inverting input and the inverting input of comparator $C_1$, causing the output of comparator $C_1$ to rise to 50 millivolts. This increases the voltage at the base of regulating transistor $T_1$, causing transistor $T_1$ to become more conductive and to raise the current flowing through the first regulated branch circuit. In the event that the current flowing through the regulated branch circuit exceeds 100 amperes, the voltage across measuring resistance $R_1$ will correspondingly increase, causing the output of comparator $C_1$ to drop accordingly, reducing the voltage at the base of regulating transistor $T_1$. Therefore, regulating transistor $T_1$ will become less conductive, reducing current flowing in the first regulated branch circuit.

Each of the other components operates in exactly the same fashion. Therefore, it can be seen that the non-inverting inputs of comparators $C_1$-$C_n$ are all used as reference inputs, while the inverting inputs thereof are used as measuring inputs which measure current through each of the regulated branch circuits.

In the event that the DC power supply which supplies current to all the branch circuits malfunctions or otherwise varies to produce less DC power, the change in current flowing through the reference branch circuit will result in a change in the voltage across second reference resistance $R_0$. As a result, current in each of the regulated branch circuits will correspondingly change.

It can thus be seen that each of the individual negative-feedback loops formed by corresponding regulating transistors, comparators, and measuring resistances serves to regulate current through the corresponding regulated branch circuit to a constant value, which constant value is determined by the current flowing through the reference branch circuit. In the event that it is desired to make the invention suitable for electroplating different objects differently, at least one of measuring resistances $R_1$-$R_n$ can be made variable by using a potentiometer. Moreover, first and second reference resistances $R_{eff}$ and $R_0$ can also be made variable, depending upon design requirements. However, in the preferred embodiment of the invention, all resistances are fixed resistors.

It will be appreciated that polarities of regulating transistors $T_1$–$T_n$, polarities of the DC source (not shown) which supplies current to the branch circuits, and the connections of comparators $C_1$–$C_n$ can all be changed as appropriate, depending upon whether the invention is to be used in the cathode circuit or in the anode circuit of an electroplating bath. However, such changes do not depart from the spirit and scope of the invention described herein.

It will be understood that each of the elements described above, or two or more together, may also find a useful application in other types of circuits and methods differing from the types described above.

While the invention has been illustrated and described as embodied in a system and method for equalizing current flow in a plurality of branch circuits such as are used in electroplating baths, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A system for equalizing DC current flow in a plurality of parallel branch circuits of an electroplating bath, wherein said plurality contains a reference branch circuit with a load constituted by a portion of said bath and at least one regulated branch circuit with a load constituted by another portion of said bath, comprising:

at least one regulating transistor having a base, a collector-emitter circuit, and an $R_{eff}$, said at least one transistor being so connected that each of said at least one regulated branch circuit includes the collector-emitter circuit of one of said at least one regulating transistor;

at least one measuring resistance, said at least one measuring resistance being so connected that each of said at least one regulated branch circuit contains one of said at least one measuring resistance;

at least one comparator having a reference input, a measuring input and an output, each of said at least one comparator being so connected that the base of each of said at least one regulating transistor is connected to the output of one of said at least one comparator and the measuring input of each of said at least one comparator is connected to an end of one measuring resistance, whereby each of said at least one measuring resistance is associated with a unique comparator connected thereto and a unique regulating transistor connected thereto, with the unique comparator and the unique regulating transistor being connected together, said at least one comparator being so connected that the reference input thereof is connected to a first common point; and a voltage divider placed in series with the reference branch circuit, the voltage divider including a first reference resistance having a resistance value equal to $R_{eff}$ and further including a reference tap which is connected to said first common point.

2. The system defined by claim 1, wherein $R_{eff}$ is constant in each of said at least one regulating transistor.

3. The system defined by claim 2, wherein each of said at least one comparator is an operational amplifier having an inverting input and a non-inverting input, and wherein the reference input is the non-inverting input and the measuring input is the inverting input.

4. The system defined by claim 3, wherein all of said at least one regulating transistor are identical.

5. The system defined by claim 4, wherein all of said at least one comparator are identical.

6. The system defined by claim 1, wherein at least one of said at least one measuring resistance is variable.

7. The system defined by claim 1, wherein all of said at least one measuring resistance are fixed and alike.

8. The system defined by claim 7, wherein the first reference resistance is fixed, wherein the voltage divider further includes a second reference resistance, and wherein the second reference resistance is identical to all of said at least one reference resistance.

9. The system defined by claim 1, wherein all of said at least one measuring resistance has a first end connected to a corresponding regulating transistor and has a second end, each second end being connected to a second common point.

* * * * *